US005848877A

United States Patent [19]

Dill et al.

[11] Patent Number: 5,848,877

[45] Date of Patent: Dec. 15, 1998

[54] WATER BLASTING SYSTEM WITH IMPROVED PRESSURE CONTROL AND METHOD

[75] Inventors: David W. Dill, Pasadena; Christopher C. Ginn, Houston; Karl E. Elliot, Houston; Michael J. Woodward, Houston, all of Tex.

[73] Assignee: Butterworth Jetting Systems, Inc., Houston, Tex.

[21] Appl. No.: 863,095

[22] Filed: May 23, 1997

[51] Int. Cl.[6] ..... F04B 49/06

[52] U.S. Cl. ..... 417/44.2; 417/34; 417/312; 417/15

[58] Field of Search ..... 417/44.2, 18, 20, 417/34, 312, 15

[56] References Cited

U.S. PATENT DOCUMENTS

| | | | |
|---|---|---|---|
| 2,317,135 | 4/1943 | Crittenden et al. | 417/15 |
| 3,864,059 | 2/1975 | Smith | 417/34 |
| 4,551,077 | 11/1985 | Pacht . | |
| 4,716,924 | 1/1988 | Pacht . | |
| 5,282,722 | 2/1994 | Beatty | 417/44.2 |
| 5,302,087 | 4/1994 | Pacht . | |
| 5,385,452 | 1/1995 | Lyday . | |
| 5,407,330 | 4/1995 | Rimington et al. | 417/312 |

OTHER PUBLICATIONS

Cover Page and pp. 2–84, Eaton Fuller Troubleshooting Guide.

*Primary Examiner*—Timothy Thorpe
*Assistant Examiner*—Cheryl J. Tyler
*Attorney, Agent, or Firm*—Browning Bushman

[57] ABSTRACT

The high pressure system 10 is provided for outputting pressurized fluid to a source, such as a blasting gun 26. The system includes mechanical transmission 14 interconnecting a diesel engine 12 with a positive displacement pump 20. A programmable controller 30 is provided for receiving signals from a pressure transducer 34 and for controlling operation of an engine controller 44, a clutch controller 42, and a transmission shifter 46 to obtain the desired fluid pressure level output from the pump. The controller preferably communicates by wireless transmission technology, so that the controller 30 may be exterior of a sound abatement enclosure 28 surrounding the engine 12 and the transmission 14. Controller 30 may be operated to automatically shift the transmission in response to fluid pressure output from the pump. Alternatively, controller 30 may receive input instructions from the operator to shift the transmission to a desired gear. In either case, the controller 30 automatically regulates engine rpm and engages and disengages the clutch for automatically shifting the transmission.

20 Claims, 3 Drawing Sheets

WATER BLASTING SYSTEM WITH IMPROVED PRESSURE CONTROL AND METHOD

FIELD OF THE INVENTION

The present invention relates to a system for regulating the pressure output by high pressure pumps and, more particularly, relates to an improved method of automatically controlling the operation of an engine and a transmission which supply torque to a high pressure pump of the type utilized in water blasting operations.

BACKGROUND OF THE INVENTION

Systems for supplying high pressure fluid to blasting guns are well known. High pressure fluid systems are commonly used to supply water or another liquid to the high pressure gun for conducting blasting operations, for concrete demolition, for surface cleaning and paint removal, for precision cutting, and for food processing applications. Conventional systems include a diesel engine which outputs power to a mechanical transmission assembly and then to a positive displacement pump of the type disclosed in U.S. Pat. Nos. 4,551,077 and 4,716,924. A plunger-type pump with an improved technique for loading compression rods is disclosed in U.S. Pat. No. 5,302,087. U.S. Pat. No. 5,385,452 discloses the desired portability of equipment for water blasting and cutting operation.

In a conventional water blasting system, power may be generated by a diesel engine which transmits mechanical energy through a mechanical transmission and a flexible coupling to positive displacement pumps. Piston or plunger-type pumps are typically desired over other types of pumps when used under conditions for generating fluid pressure in excess of 1,000 psi. In a conventional application, the operator may manipulate a standard clutch, an engine throttle, and a mechanical gear shift assembly to operate the engine and transmission, thereby supplying the required rpm and torque output to the pump for generating and maintaining the desired high pressure from the pump. Systems of this type are commonly used throughout the world for high pressure blasting applications.

One problem associated with prior art high pressure blasting systems is the noise associated with the engine and transmission. Various techniques have been devised for reducing the noise, but effective decibel levels are most easily obtained by enclosing at least the engine and transmission within a sound abatement enclosure. One of the difficulties with enclosing the engine and transmission with a standard sound abatement enclosure is that the enclosure itself practically prevents the operator from easy access to the engine throttle control, the clutch, and the gear shift lever. If the operator opens a door or other moveable section of the enclosure to operate the engine, a significant portion of the benefit of the enclosure is lost. Moreover, when controlling the high pressure blasting system, the operator within the enclosure is obviously subject to the high engine and transmission noise. Accordingly, a significant limitation on the effectiveness of sound abatement enclosures to reduce the noise output from high pressure systems results from the need of the operator to frequently gain access to these controls and thereby maintain the desired pump pressure.

Another problem with high fluid pressure systems is that skilled operators are required to frequently manipulate the engine throttle and the clutch to manually shift the transmission to another selected gear to maintain the desired fluid pressure. Unless those operations are conducted by a skilled equipment operator, the desired high pressure capability of the pump is not realized, and the blasting efficiency is significantly reduced. In some cases, significant damage to the engine and/or transmission may occur as a result of an operator improperly regulating the engine and/or shifting the transmission. High maintenance for this equipment is thus another drawback which limits the use of this high pressure equipment. The continual operation of regulating the engine and transmission cause strain on the operator, which is heightened by the high noise level of the equipment.

The disadvantages of the prior art are overcome by the present invention, and an improved high pressure system and technique for controlling a high pressure system are hereinafter disclosed. The improved system and technique of this invention will significantly contribute to the long life and reduced maintenance costs for high pressure blasting systems. The present invention is particularly well suited for supplying mechanical energy to a plunger-type pump used in water blasting and cutting operations. The stress and strain on the equipment operator is significantly reduced, and the noise level output from the equipment may be reduced without adversely affecting system pressure.

SUMMARY OF THE INVENTION

The high pressure blasting system of the present invention includes a conventional engine, a mechanical transmission, a positive displacement pump, and a flexible coupling which interconnects the transmission and the pump. Fluid output by the pump may be passed to a flexible hose which then supplies high pressure fluid to a blasting or cutting gun. In a preferred embodiment, the engine and transmission are enclosed within a sound abatement enclosure to significantly reduce the noise level in the vicinity of the equipment.

The system of the present invention includes a pneumatic or hydraulic cylinder for shifting the clutch and another cylinder for regulating the engine throttle. A shift tower is provided for operating the mechanical transmission. Operation of the shift tower and the cylinders is regulated by the programmable controller which is external of the enclosure. The controller thus allows the operator to reliably operate the engine and transmission to achieve a desired pressure level output from the pump while these components remain fully enclosed within the sound abatement enclosure.

The system of the present invention preferably allows the operator to input the desired pump operating pressure, and then allows logic within the controller to automatically regulate the engine speed, control the clutch, and shift the transmission to achieve the desired fluid pressure. The controller receives an input from a pressure transducer in order to monitor the pressure output by the pump, and provides output signals to the pneumatic cylinders and the shift tower to regulate the operation of these components. Engine throttle control may be obtained using a ball drive linear actuator in combination with the pneumatic cylinder, thereby allowing for both rapid acceleration and deceleration of the engine as well as finely controlled engine speed. The pneumatic cylinder which controls the clutch may operate in conjunction with a conventional torque arm. The shift tower may be of the type used in a semi-automatic transmission but modified to provide for reliably operating the mechanical transmission.

It is an object of the present invention to provide an improved system for obtaining high pressure fluid output from a pump by controlling the operation of an engine and transmission which provide mechanical power to the pump. It is a related object of the invention to provide a system for automatically controlling the operation of an engine, a clutch, and a mechanical transmission for regulating power to the pump. The system of the present invention allows an operator to input a desired fluid pressure level to the controller. A signal indicative of the actual pressure level output by the pump is thus input to a controller, and the output from the controller then regulates the engine speed, the clutch, and the transmission so that the pump outputs a fluid pressure within the desired pressure range. In an alternative embodiment, the operator may input a desired flow rate from the pump, so that the system regulates the engine and transmission to output the desired flow rate from the pump.

It is a significant feature of the present invention that the controller may be remote from the engine and transmission, thereby allowing the engine and transmission to be enclosed within a sound abatement enclosure.

Yet another feature of the invention is that strain and stress on the high pressure equipment operator is significantly reduced. The equipment may be operated in a substantially automatic manner, or alternatively the operator may input instructions to the controller located exterior of an enclosure, thereby regulating the engine, the clutch and the transmission.

It is another significant feature of the present invention that substantially automatic control of the engine and transmission are obtained at a fraction of the cost of utilizing an automatic transmission. The present invention thus employs a manual transmission, which is significantly more economical to purchase and to maintain than an automatic transmission.

It is an advantage of the present invention that the controller allows the high pressure system to be easily upgraded. A "smart" controller may thus regulate the shifting of the transmission so that wear on the transmission is substantially uniformly distributed over each of the transmission gears. The system of the present invention also may be easily adapted for outputting signals indicative of the operation of the pump, thereby enhancing pump maintenance and prolonging the life of the pump. These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
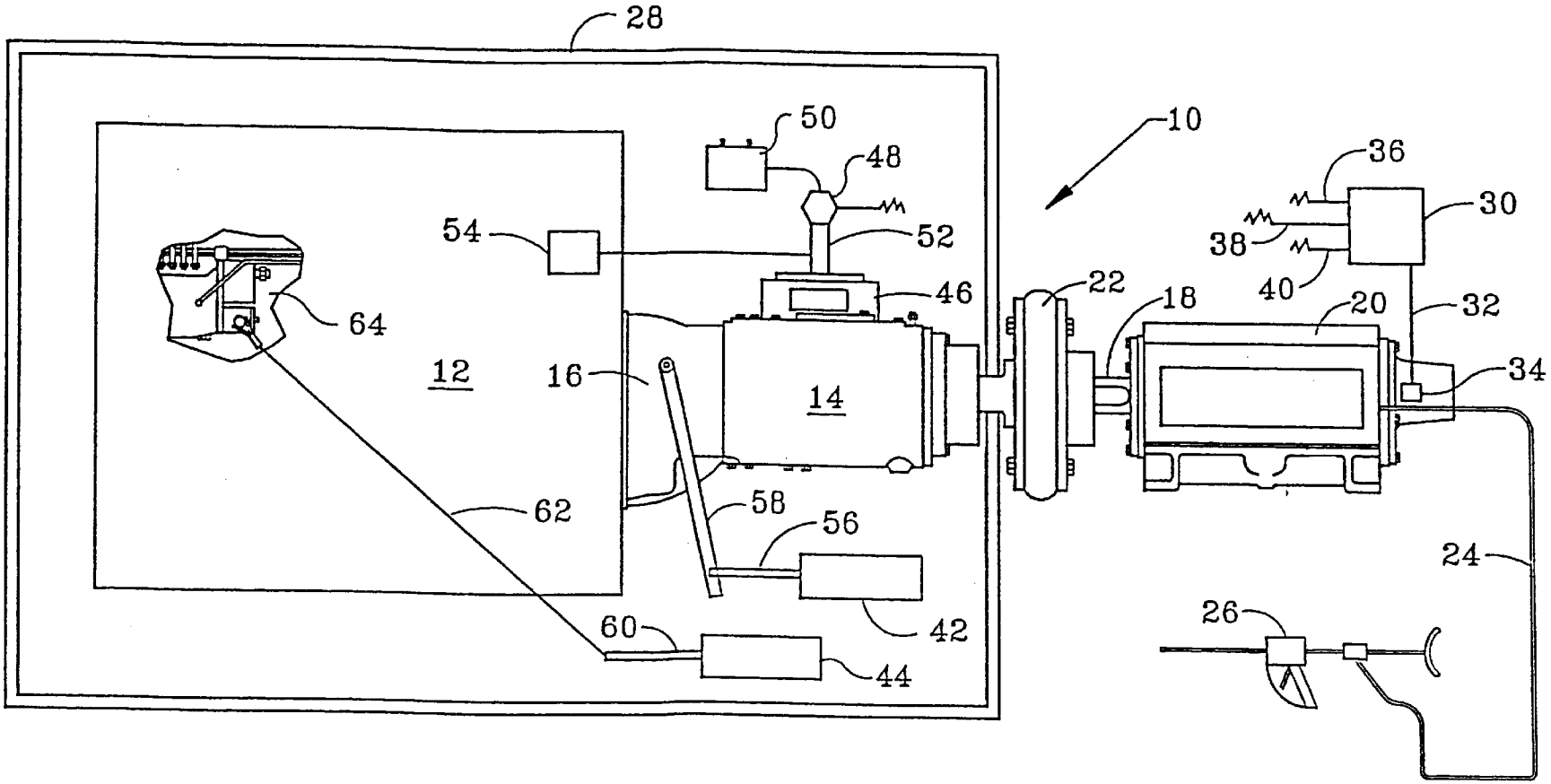
FIG. 1 is a simplified pictorial view of a suitable engine, transmission, and pump which supply high pressure fluid to a blasting gun. The engine and transmission are shown to be enclosed within a sound abatement enclosure.

FIG. 1 depicts a high pressure system 10 according to the present invention suitable for a water blasting or cutting operation. A conventional diesel engine 12 provides power to a mechanical (or manual) transmission 14 which includes at least three and preferably about ten gears. The power from the engine 12 to the transmission 14 passes through a conventional mechanical clutch 16. The output from the mechanical transmission 14 is thus torque energy in shaft 18 which supplies power to the positive displacement pump 20. A flexible coupling 22 is provided for interconnecting the transmission 14 and the pump 20.

High pressure water is output from the pump 22 via flexible line 24, which interconnects the pump 20 with the blasting or cutting gun 26. The gun 26 may be easily positioned by the operator with respect to the pump 20 to maximize the efficiency of the cleaning or cutting operation, and the entire system 10 as shown in FIG. 1 may be skid mounted for enhanced portability. The gun 26 is conventionally controlled by a blasting operator, and may be used in various blasting, cleaning and cutting operations. The pump 20 may be of the type capable of outputting at least 10,000 psi, and preferably in the range of from 10,000 to at least 40,000 psi.

In order to minimize noise output from the system 10, the engine 12 and the transmission 14 are enclosed in a sound abatement enclosure 28. Enclosure 28 typically has a cube-shape, with side walls and the top fabricated from conventional sheet metal and sound abatement insulation. A controller 30 is external of the enclosure 28, and receives an input signal along line 32 from pressure transducer 34. Controller 30 thus receives repeated signals from transducer 34 indicative of the pressure output from the pump 20. The controller provides at least three output signals designated as 36, 38 and 40, respectively, which control respective components within the enclosure 28 as described subsequently. Although the controller 30 may be connected to components within the enclosure 28 by conventional hard wiring, in a preferred embodiment of the invention the controller 30 outputs high frequency signals, preferably in the radio frequency range, which are received by conventional receivers associated with each operated component.

The components within the enclosure 28 regulated by the controller 30 include a clutch control mechanism 42, a throttle control mechanism 44 and a shifting tower 46. Referring to the shifting tower 46, a radio frequency receiver 48 is depicted in block diagram form for receiving the signal 36 from the controller 30. Low energy power to the receiver 48 may be provided by a conventional 12 volt battery 50 conventionally provided for starting the diesel engine 12. An electrical signal from the receiver 48 controls one or more pneumatic solenoids 52. The solenoids 52 receive pneumatic power from an air compressor 54, which may also be provided as part of the diesel engine 12. Accordingly, the diesel engine 12 may power a suitable fluid generating source, such as air compressor 54. Alternatively, pressurized air or other hydraulic fluid may be supplied to the controlled components within the enclosure 28 from a source (not shown) external of the enclosure. The solenoids 52 in turn control the shifting tower 54, as explained in detail below, thereby shifting the gears in the transmission 14.

Although not depicted, it should be understood that a similar electrical receiver and solenoid are associated with each of the clutch control mechanisms 42 and the throttle control mechanisms 44. These additional receivers and pneumatic solenoids are also provided with power from the battery 50 and the air compressor 54, as discussed above. The signal 38 from the controller 30 thus operates the pneumatic solenoid associated with the clutch control 52, and the signal 40 from a controller 30 similarly operates the throttle control mechanism 44.

The clutch control mechanism 42 includes a pneumatic cylinder which receives power from the air compressor 54 to control the position of moveable rod 56 relative to the stationary cylinder housing. The rod 56 in turn is mechanically coupled to torque arm 58, which operates the clutch 16 in a conventional manner. Accordingly, those skilled in the art should now understand that when the rod 56 is retracted, the clutch 16 is engaged and power from the engine 12 is supplied to the transmission 14. When the rod 56 is extended, clutch 16 is disengaged, thereby disrupting power to the transmission 14 and allowing the transmission to be safely shifted. Alternatively, mechanical linkage may be used so that the clutch is engaged by extension of the rod 56, and is disengaged by retraction of the rod.

Figure 3:
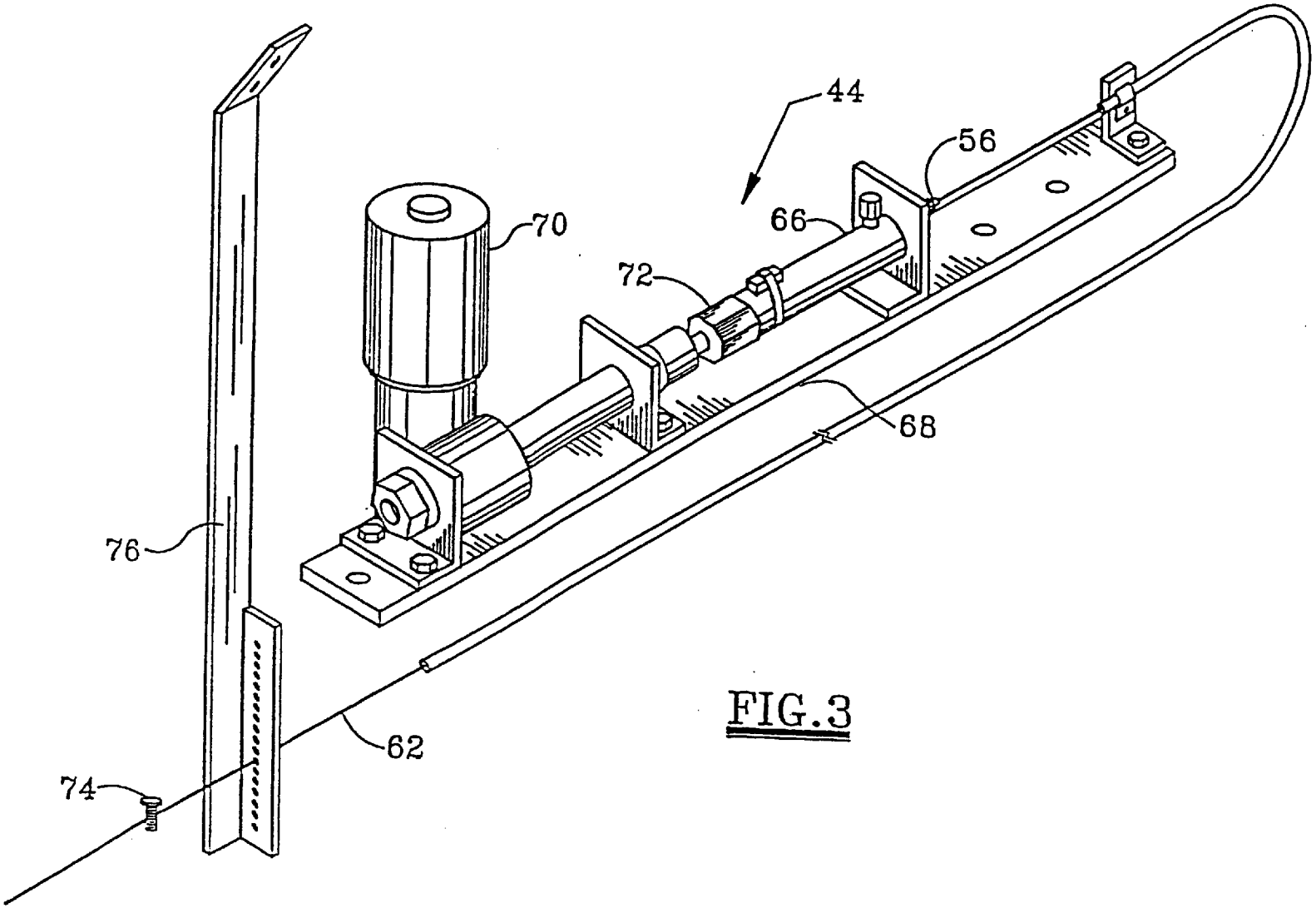
FIG. 3 is a pictorial representation of a suitable mechanism for operating the engine speed in response to signals from the controller.

The throttle control mechanism 44 includes a similar pneumatic cylinder, and rod 60 is extended or retracted to move cable 62 which is interconnected with throttle linkage 64 of the engine 12. The signal 40 may thus be used to regulate the throttle control mechanism 44, thereby controlling the speed or rpm output by the engine 12. A suitable throttle control mechanism is shown in FIG. 3 and is discussed further below.

Figure 2:
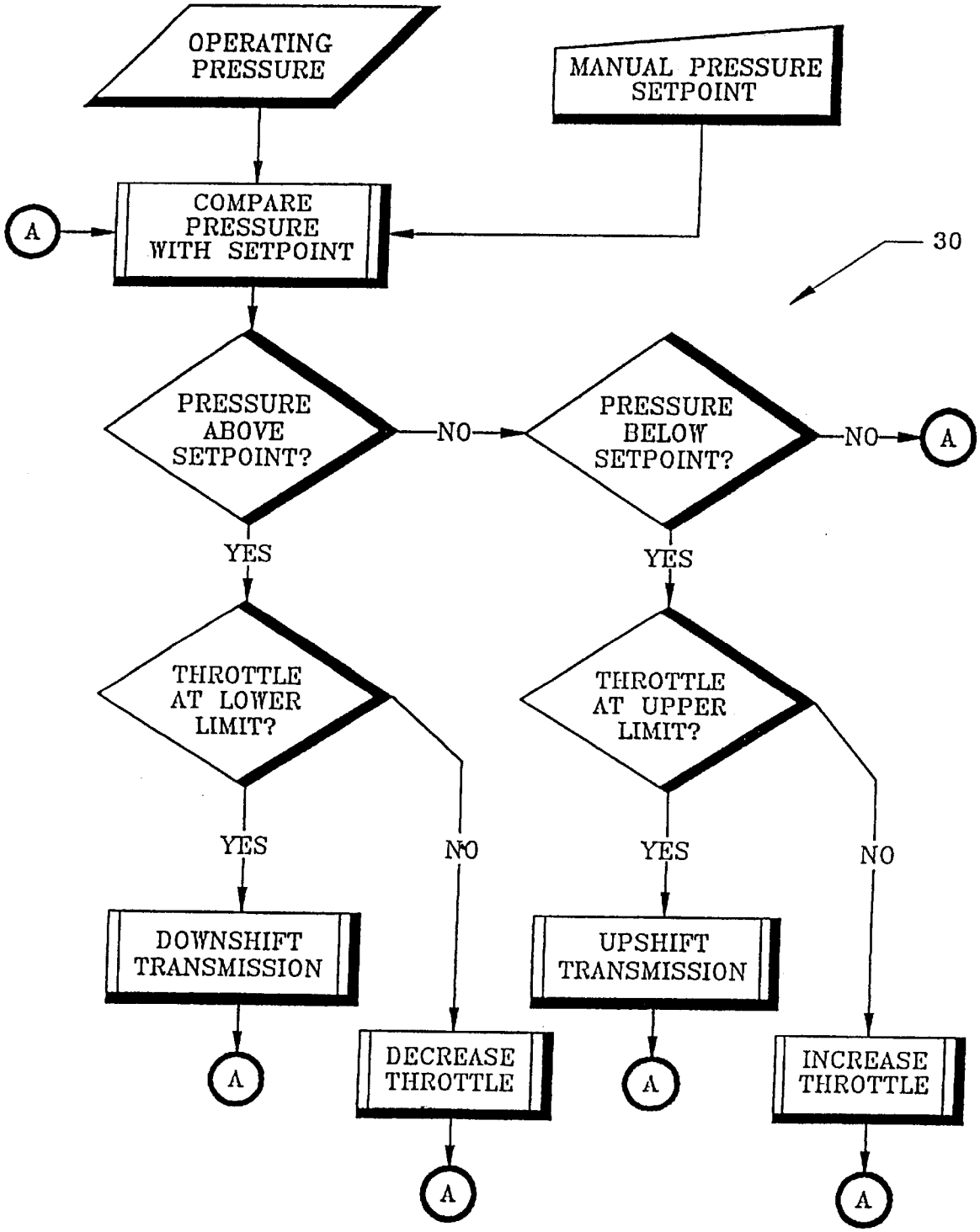
FIG. 2 is a block diagram indicating the logic of the controller according to the present invention.

Referring now to FIG. 2, a flow block diagram of the logic for the controller 30 is provided. As previously discussed, the controller 30 receives an operating pressure signal from the transducer 34, and also receives a pressure set point signal which is manually input by the operator. The controller 30 thus compares the pressure set point with the operating pressure to determine if the pressure output by the pump is above or below the selected operating pressure. In a typical application, the operator may input a selected pressure of 32,000 psi for desirably being supplied to the gun 26, and for this case the controller 30 compares this manual pressure set point (or more particularly a set point range as discussed below) with the operating pressure to determine if signals should be output to the clutch control 42, the throttle control 44 and/or the shift tower 46 to alter the rpm of the shaft 18 or shifts transmission gears to thereby alter the pressure output by the pump 20.

The block diagram of the controller 30 as shown in FIG. 2 preferably provides a selectively adjustable pressure range for operating the gun. In the above example, the manual pressure set for 32,000 psi may thus cause the controller 30 to generate signals to alter the pump pressure only if the pressure is lower than 31,000 psi, or is above 33,000 psi. This pressure variation from the set point may be fixed within the logic of the computer, or if desired may be adjusted by the operator. If the pressure is above the upper set point, e.g., above 33,000 psi, the computer within the controller then asks if the throttle 84 is at a predetermined lower limit. If the throttle is not at the predetermined lower limit, e.g., engine speed at 1,500 rpm, signal 40 is output from the controller to the throttle control mechanism 44 and the throttle is decreased. This decrease may either be in a preselected amount, or if desired the throttle decrease signal may continue until the fluid pressure from the transducer 34 drops below 33,000 psi. If the throttle is already at its lower limit, e.g., 1,500 rpm, the computer then determines that the transmission 14 should be downshifted to a lower gear. During this downshifting operation, signal 40 from the controller first regulates the throttle control mechanism 44 so that the throttle is reduced to substantially idle speed. The signal 38 from the clutch then causes actuation of the clutch controller 42 to disengage the clutch 16. With the clutch 16 disengaged, the signal 36 from the controller then operates the solenoids 52 to downshift the transmission 14 to the next lower speed, e.g., from 6th gear to 5th gear. Once the downshift operation has occurred, signal 38 causes the clutch control mechanism 42 to reengage the clutch, and signal 40 from the controller causes the throttle control mechanism 44 to return the engine to its previous operating speed.

If the pressure signal from the transducer 34 is not above the upper set point of 33,000 psi, the logic within the controller 30 then determines if the pressure is below the minimum set point, e.g., 31,000 psi. If the pressure is not below the minimum set point, the system continues operating as described above, repeatedly comparing the operating pressure to the manual pressure set point at selected time intervals. If the operating pressure is below the lower set point, the computer determines if the throttle is at the upper limit. If the throttle is not at the upper limit, the signal 40 from the controller regulates the throttle control mechanism 44 to increase the throttle, thereby raising the rpm supplied to the pump and increasing the fluid pressure above the lower limit. If the throttle is already at the upper limit, e.g., 2,500 rpm, the computer then determines that the transmission 14 should be upshifted. This upshift operation is conducted in substantially the same manner as the downshift operation described above, except that in the upshift operation the solenoids 52 operate the shift tower 46 to upshift the transmission to the next higher gear, thereby raising the rpm supplied to the pump 20 and increasing the pressure output from the pump.

FIG. 3 is a pictorial representation of a suitable throttle control mechanism 44 generally shown in FIG. 1. The throttle control mechanism 44 includes a pneumatic cylinder 66 with a cylinder rod 56 extending therefrom as previously described to control movement of the cable 62, which in turn is interconnected to the throttle linkage 64 of the engine. Throttle control mechanism 44 is mounted on a stationary plate 68 with brackets as depicted for supporting the pneumatic cylinder 66. A ball drive linear actuator 70 is provided for operating in conjunction with the cylinder 66. As described above, operation of a pneumatic solenoid controls the extension and retraction of the rods 56 from the cylinder 66 to achieve both rapid acceleration and deceleration of the engine when shifting the transmission gears. Fluid pressure is thus supplied to the cylinder 66 to rapidly increase and decrease throttle speed during the shifting operation. The ball drive linear actuator 70 provides accurate high speed control of the engine. Signal 40 from controller 30 thus is input to the actuator 70 to carefully increase or decrease the throttle speed by desired incremental amounts to slowly increase or decrease the engine rpm and thus the pressure output from the pump 20. A connector 72 interconnects the actuator 70 with the cylinder 66 to achieve careful regulation of the throttle mechanism. A conventional throttle adjustment mechanism 74 may be provided for cooperating with bracket 76 to allow the system operator to easily adjust the idle speed of the engine.

In an alternative embodiment, a flow rate sensor is used instead of a fluid pressure sensor, and the controller 30 regulates the engine and the transmission to output a desired flow rate (or a flow rate range) from the pump. In yet another embodiment, both fluid pressure and flow rate sensor signals are input to the pump, and logic within the controller regulates the engine and the transmission so that both fluid pressure and flow rate are as close as possible to desired values.

For further improving the regulation of the high pressure system by the controller 30, various sensors or switches may be provided to provide feedback information to the controller indicative of the position of components. For example, a pressure switch or similar signal generator 86 may be associated with the throttle linkage 64 for providing a signal to the controller that the throttle in fact has reached substantially an idle position, thereby providing assurance to the controller that the clutch controller 42 and transmission shifter 46 may be operated. Similarly, a plurality of switches or sensors 88 and 90 may be associated with the transmission shifter 46 to provide positive indications to the controller 30 that the transmission 14 is operating within or has been shifted to one or more of the plurality of gears. Moreover, a blasting gun shutoff controller 92 may be provided for providing an indication to the controller 30 that the trigger of the blasting gun has been disengaged, i.e., that the blasting gun is not being operated. When the blasting gun is not being operated, the signal from the transducer 34 may be disregarded so that regulation of the engine controller 44, the clutch controller 42, and the transmission shifter 46 does not occur at this time. In effect, the controller 30 is functionally operative when the blasting gun is being operated, and when the blasting gun operator releases trigger on the gun 26, the controller effectively disregards signals from the transducer 34 during that time. When the blasting gun operator again depresses the trigger to force high pressure water through the gun 26, the function and purpose of the controller 30 is resumed. Each of the switches or sensors 86, 88, 90 and 92 are thus in communication with the controller 30. In a preferred embodiment, this communication is again provided by radio transmission, although less desirably these components could be hardwired to controller 30. The communication between the controller 30 and both the components 66, 68, 70 and 72 discussed above as well as the controlled components 42, 44, and 46 may be accomplished with radio frequency signals, and those skilled in the art will appreciate that various other types of conventional wireless communication mechanisms could be used for this purpose.

The controller 30 may also include a display screen 74 which may include one or more gauges 76 for depicting various functions of the engine 12, the transmission 14, or the pump 20. For example, conventional sensors (not shown) may be provided on the engine so that the gauges 76 depict engine rpm, pressure to the pump, the gear in which the transmission is operating, or other selected features of the equipment components. The controller 30 may also include one or more operator controls 78. These operator controls may be used to input a desired pump pressure to be output by the pump 20 or the desired gear in which the transmission 14 is to be operated. The controls 78 may also be used for conventional purposes such as starting or stopping the engine 12, or for providing emergency shutoff for the system.

It is to be understood that the controller 30 may function in an automatic mode, as explained above, wherein the engine is initially started by the operator and the controller 30 thereafter to automatically shifts the transmission from first gear to second gear, from second gear to third gear, from third gear to fourth gear, etc. until the desired pressure level is obtained. Alternatively, the controller 30 may be operated in a manual mode, so that the operator can dictate to the controller the desired gear in which he wants the transmission 14 to operate. Assuming the transmission is, for example, in third gear while in an automatic mode and the operator wants the transmission to operate in fourth gear, the operator may thus input instructions to the controller to cause the controller to output signals which will cause the transmission 14 to shift to the fourth gear. This shifting operation will still be performed in the automatic sense, in that the signals 36, 38 and 40 will be output to the transmission shifter 48, the clutch controller 42, and the engine controller 44 to shift the transmission as described above.

The significant advantage of the present invention is that the system utilizes a mechanical transmission 14, which may be manufactured at a fraction of the cost of an automatic transmission. Moreover, a manual transmission as used according to the present invention may be repaired and serviced at a lower cost than an automatic transmission. High system reliability is obtained at a significantly lower cost.

Those skilled in the art will appreciate that any type of pump may be controlled using the concepts of the present invention, although the invention is particularly well suited for controlling a positive displacement pump. The cost of providing the remote controller is relatively low in view of the significant benefits obtained by the present invention. In other embodiments, the controller 30 is a "smart" controller, and provides a more sophisticated program to automatically regulate the band width between the upper pressure limit and lower pressure limit as a function not only of the operator input pressure, but also as a function of the frequency of the shifting operation. This feature may be important to limit the system operation so that the transmission is not upshifting and downshifting at too high a frequency. In another embodiment, the controller may automatically record system operating conditions. The periodic output of this stored information from the controller may thus be used to determine the number of hours the transmission is operating in a certain gear. This information may assist in scheduling repair or maintenance operations. Also, if the transmission is operating at a high frequency in a specific gear, the system may automatically regulate the upshifting and downshifting to decrease the frequency of operating in that gear, and instead operate the transmission in the next higher or next lower gear and thereby prolong the term between service of the transmission.

Since the controller 30 is preferably programmable, those skilled in the art will appreciate that the system operation may be easily modified by inputting program instructions to the controller. Moreover, instructions may be input by conventional telemetry techniques, including for example satellite linkage, so that the engine and transmission are regulated from a location remote from the pump. A system operator in Houston, Tex. may thus input instructions to the controller 30 of a pumping station located in Louisiana, and thereby control the pressure output by the high pressure pump.

A suitable engine according to the present invention is manufactured by Cummins, and is available under Model 6BTA 5.9. The engine has approximately a 200 horsepower rating. A suitable shift tower is manufactured by Eaton under Model No. K2983. This shift tower was not designed to be used on a mechanical transmission, however, accordingly the shift tower had to be modified to be suitable for mounting by a bolted connection to the top of a manual transmission. A suitable ball drive linear actuator is manufactured by Motions System and is available under Model 85151. Finally, any number of controllers with computers may be used according to the present invention, depending on the computing and storage capacity desired. A suitable unit is manufactured by PLC Direct and is available under Model DL205.

Various other modifications and alterations to the embodiments and the methods as described herein should now be apparent to one skilled in the art in view of the foregoing disclosure. Such modifications may be made in accordance with the teachings of the present invention, which is not restricted to the embodiments discussed herein and shown in the accompanying drawings. The scope of the invention should thus be understood to include all embodiments within the foregoing claims.

What is claimed is:

1. A pressure system for outputting pressurized liquid to a source, such as a blasting gun, the system comprising:

a power source;

a manual transmission including a plurality of gears;

a clutch for interconnecting the power source and the manual transmission;

a positive displacement pump powered by the power source through the manual transmission;

an throttle controller for controlling the speed of the power source;

a clutch controller for controlling the operation of the clutch;

a transmission shifter for shifting the gears in the manual transmission;

a pressure transducer for outputting a signal indicative of liquid pressure output by the pump; and a programmable controller for receiving signals from the pressure transducer and for controlling the operation of the engine controller, the clutch controller, and the transmission shifter to obtain a desired liquid pressure level output from the pump.

2. The system as defined in claim 1, further comprising:

a sound abatement enclosure for enclosing the power source and the manual transmission; and the programmable controller is external of the sound abatement enclosure.

3. The system as defined in claim 1, wherein each of the clutch controller and the throttle controller includes a cylinder assembly responsive to fluid pressure.

4. The system as defined in claim 3, further comprising:

a fluid pressure generator powered by the power source for supplying fluid pressure to the clutch controller and the throttle controller.

5. The system as defined in claim 1, wherein the programmable controller includes an operator input for selectively inputting a desired pump operating pressure value.

6. The system as defined in claim 1, wherein the power source is a diesel engine.

7. The system as defined in claim 1, further comprising:

a flexible coupling for interconnecting the manual transmission and the positive displacement pump.

8. The system as defined in claim 1, wherein the programmable controller outputs wireless signals to a receiver for controlling the engine controller, the clutch controller, and the transmission shifter.

9. The system as defined in claim 1, wherein the engine controller comprises a fluid powered cylinder assembly and a linear actuator.

10. The system as defined in claim 1, further comprising:

one or more sensors for sensing a condition relative the engine speed, transmission shift, and blasting gun operation and for supplying a corresponding signal to the controller.

11. A pressure system for outputting pressurized liquid to high pressure discharge gun, the system comprising:

a diesel engine;

a manual transmission including a plurality of gears;

a clutch for interconnecting the diesel engine and the mechanical transmission;

a sound abatement enclosure for enclosing the diesel engine and the manual transmission; and a positive displacement pump powered by the diesel engine through the manual transmission;

an engine controller for controlling the speed of the diesel engine;

a clutch controller for controlling the operation of the clutch;

a transmission shifter for shifting the gears in the manual transmission;

a pressure transducer for outputting a signal indicative of liquid pressure output by the pump; and a programmable controller external of the sound abatement enclosure for receiving signals from the pressure transducer and for controlling the operation of the engine controller, the clutch controller, and the transmission shifter to obtain a desired liquid pressure level output from the pump.

12. The system as defined in claim 11, wherein the programmable controller outputs wireless signals to a receiver for controlling the engine controller, the clutch controller, and the transmission shifter.

13. The system as defined in claim 11, wherein the programmable controller includes an operator input for selectively inputting a desired pump operating pressure value.

14. The system as defined in claim 11, further comprising:

a flexible coupling for interconnecting the manual transmission and the positive displacement pump.

15. The system as defined in claim 11, wherein the engine controller comprises a fluid powered cylinder assembly and a linear actuator.

16. A method of regulating the pressure output to a liquid pressure receiving source, such as a blasting gun, the method comprising:

providing a manual transmission including a plurality of gears between an engine and a positive displacement pump;

providing a clutch for selectively engaging and disengaging the engine and the manual transmission;

repeatedly generating a liquid pressure signal indicative of liquid pressure output by the pump;

automatically controlling the speed of the engine in response to the liquid pressure signal;

automatically engaging and disengaging of the clutch in response to the liquid pressure signal; and automatically shifting the gears in the manual transmission in response to the liquid pressure signal, such that a selected liquid pressure is output by the pump by automatically controlling the engine speed and shifting of the transmission.

17. The method as defined in claim 16, further comprising:

enclosing the engine and the manual transmission within a sound abatement enclosure; and positioning a programmable controller external of the sound abatement enclosure for controlling the speed of the engine, the engaging and disengaging of the clutch and the shifting of the transmission.

18. The method as defined in claim 17, further comprising:

selectively inputting a desired pump operating pressure value to the controller.

19. The method as defined in claim 17, further comprising:

outputting wireless signals from the controller to a receiver for controlling the engine speed, the clutch, and the transmission.

20. The method as defined in claim 16, further comprising:

sensing a condition relative the engine speed and transmission shift and supplying a corresponding signal to a controller.

* * * * *

UNITED STATES PATENT AND TRADEMARK OFFICE

CERTIFICATE OF CORRECTION

PATENT NO. : 5,848,877
DATED : December 15, 1998
INVENTOR(S) : David W. Dill, et al.

It is certified that error appears in the above-indentified patent and that said Letters Patent is hereby corrected as shown below:

In column 9 line 59, change "mechanical" to --manual--.

Signed and Sealed this

Thirtieth Day of March, 1999

*Attest:*

*Attesting Officer*

Q. TODD DICKINSON

*Acting Commissioner of Patents and Trademarks*